US005277004A

United States Patent [19]

Frei

[11] Patent Number: 5,277,004

[45] Date of Patent: Jan. 11, 1994

[54] APPARATUS AND METHOD FOR REINFORCING SWIMMING POOL WALL STRUCTURES

[76] Inventor: Hans Frei, 4 Jacob Arnold Rd., Morristown, N.J. 07960

[21] Appl. No.: 996,529

[22] Filed: Dec. 23, 1992

Related U.S. Application Data

[63] Continuation of Ser. No. 888,437, May 22, 1992, abandoned, which is a continuation of Ser. No. 742,469, Aug. 5, 1991, abandoned.

[51] Int. Cl.[5] ..... E04H 4/00

[52] U.S. Cl. ..... 52/169.7; 52/582; 52/584; 4/506

[58] Field of Search ..... 52/169.7, 656.1, 656.9, 52/657, 245, 631, 582, 584; 4/506, 487, 488; 403/401, 402, 403

[56] References Cited

U.S. PATENT DOCUMENTS

| | | | |
|---|---|---|---|
| 2,049,925 | 8/1936 | Rafter | 52/657 |
| 3,142,069 | 7/1964 | O'Connell et al. | 52/169.7 X |
| 3,487,600 | 1/1970 | Greene | 52/169.7 X |
| 3,720,964 | 3/1973 | Thomson | 52/221 X |
| 3,789,435 | 2/1974 | Heisner | 52/169.7 X |
| 3,938,199 | 2/1976 | Laven | 52/169.7 X |
| 4,125,970 | 11/1978 | Vidal | 52/169.7 X |
| 4,635,304 | 1/1987 | Zikmanis et al. | 52/169.7 X |
| 4,860,914 | 8/1989 | Derni et al. | 52/169.7 X |
| 4,878,777 | 11/1989 | Debus et al. | 403/403 X |
| 5,010,603 | 4/1991 | Hertzog | 52/169.7 X |

*Primary Examiner*—Carl D. Friedman
*Assistant Examiner*—Robert J. Canfield
*Attorney, Agent, or Firm*—Hopgood, Calimafde, Kalil, Blaustein & Judlowe

[57] ABSTRACT

A structural wall unit for retaining wall structures of in ground swimming pools, whereupon assembly of a plurality of wall units in series, a circuitous pathway is formed which defines the swimming pool shape. In accordance with one aspect of the present invention, each unit includes end surfaces comprising folded portions at the corners thereof for reinforcement of the wall unit, at least one of the surfaces being formed for engagement with a corresponding end surface of an adjacent unit. The units are fastened one to the other so as to form the circuitous wall structure. Each unit includes a base or lower wall for supporting the unit in an upright position and a gusset plate having apertures adapted for cooperation with matching holes on a pair of adjacent folded portions of an end surface, each of the folded portions being adapted to overlie the gusset plate. Upon engagement of the plate with the folded portions, complementary connectors formed in the folded portions engage the apertures so as to secure the plate to the folded portions and reinforce the wall unit.

6 Claims, 2 Drawing Sheets

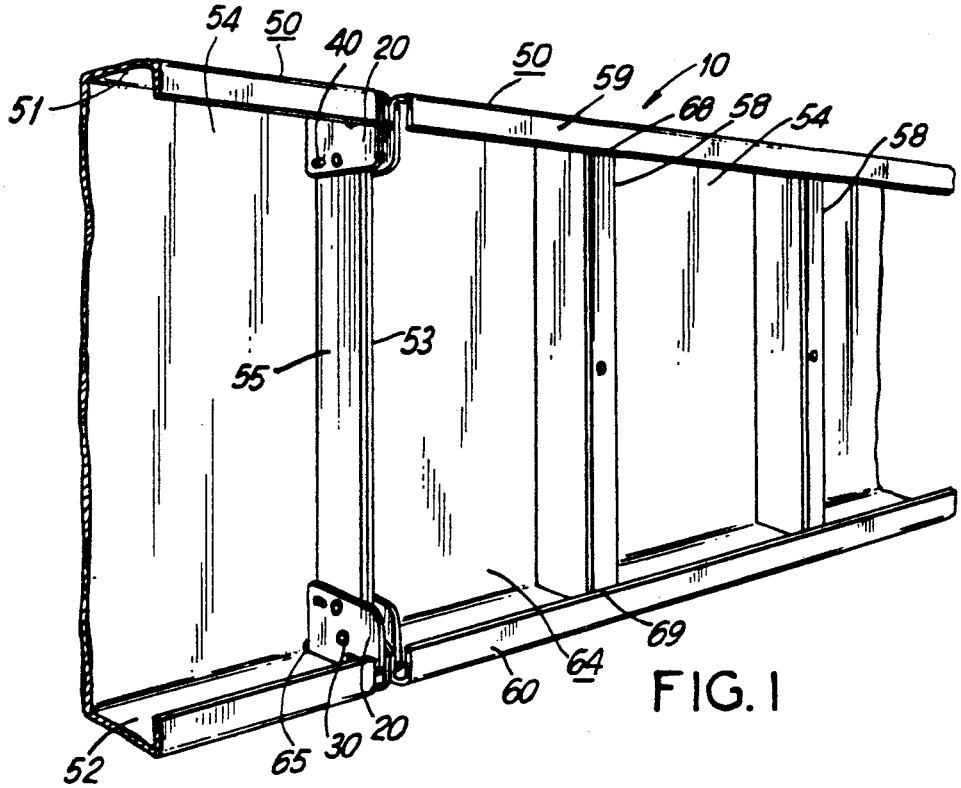
FIG. 1
FIG. 2
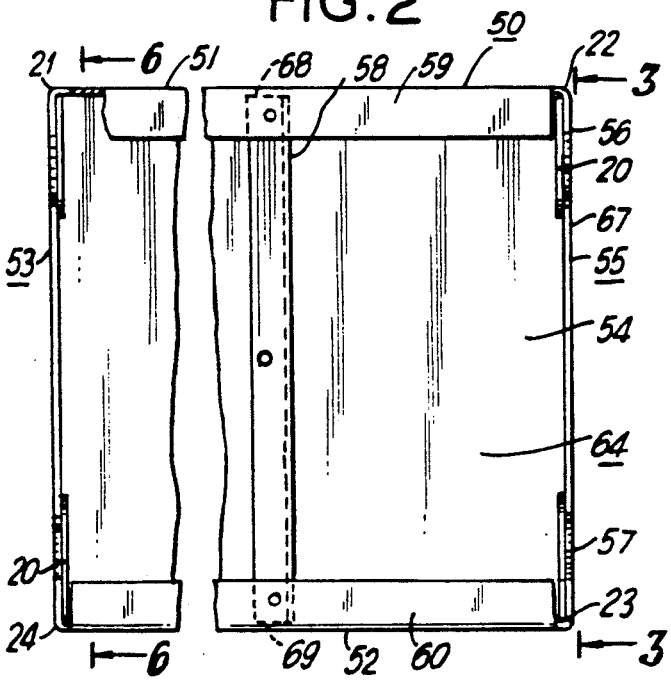
FIG. 3
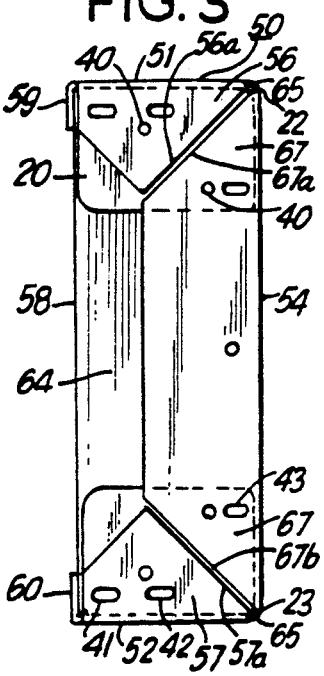

APPARATUS AND METHOD FOR REINFORCING SWIMMING POOL WALL STRUCTURES

This application is a continuation of application Ser. No. 888,437, filed May 22, 1992, now abandoned which is a continuation of Ser. No. 742,469 filed Aug. 5, 1991, now abandoned.

DISCLOSURE OF THE INVENTION

The invention relates to apparatus used for the reinforcement of retaining wall structures and, more specifically, to an improved apparatus and method for reinforcing retaining walls of in ground swimming pools.

In ground swimming pool walls are subjected to large static and dynamic loads. In particular, both the water mass contained within the pool and the mass of material (such as earth, concrete or the like) which surrounds the pool subject the walls to excessive compressive and shearing forces. Therefore, it is necessary that these wall structures be reinforced to withstand the multitude of loads exerted continuously upon the pool when it is filled with water as well as when it is empty. In addition, because the wall structures are often embedded in earth or concrete, reliable and maintenance free means must be provided for securing each wall section of the structure to the other.

Conventional swimming pool walls are provided with a series of mitered wall sections having ends adapted for connecting one section to the other to form a closed circuit which defines the swimming pool shape. Each wall section or unit is generally constructed of galvanized metal and is mounted to adjacent units by welding together the respective ends thereof. Other wall units utilize bracket assemblies mounted to corresponding unit ends; overlapping folded corner sections bolted to one another; or have interlocking metal systems at each end to interconnect the wall units and provide added structural integrity to the retaining wall structure.

However, the welding of the galvanized metal parts causes deterioration of the galvanized layer and exposure of the metal below. When subjected to soil moisture in the underground environment, oxidation of the exposed metal often results, which, hence, defeats the purpose of the galvanized layer. Moreover, the use of overlapping or interlocking folded corner sections to reinforce the unit and secure each unit to another has been found to lack durability and reliability when subjected to the continuous pulling stresses exerted between the assembled wall units in the underground environment.

It is thus an object of the present invention to provide a durable and reliable apparatus and method for reinforcing retaining wall structures adapted for use in the underground environment of in ground swimming pools.

The above and other objects of the present invention are realized in specific, illustrative apparatus for reinforcing retaining walls of in ground swimming pools which comprise a structural wall unit having end surfaces with folded portions at the corners thereof for reinforcement of the wall unit, at least one of the surfaces being formed for engagement with a corresponding end surface of an adjacent unit, and means for fastening the units one to the other so as to form a circuitous retaining wall structure, which, upon assembly of a plurality of units in series, defines the swimming pool shape; means mounted to each unit for supporting the unit in an upright position; and a gusset plate having apertures adapted for cooperation with matching holes on a pair of adjacent folded portions, the folded portions being adapted to overlie the gusset plate; whereupon positioning of the plate against the folded portions, complementary connectors formed in the folded portions engage the apertures so as to secure the plate to the folded portions and reinforce the wall unit.

The above and other features and advantages of the present invention are realized in a specific, illustrative embodiment thereof, presented hereinbelow in conjunction with the accompanying drawings, in which:

FIG. 1 is a perspective view of retaining wall units assembled in series in accordance with the present invention;

FIG. 2 is an elevation view of a retaining wall unit of the present invention;

FIG. 3 is an end view of the retaining wall unit of FIG. 2 taken along line 3—3;

Figure 4:
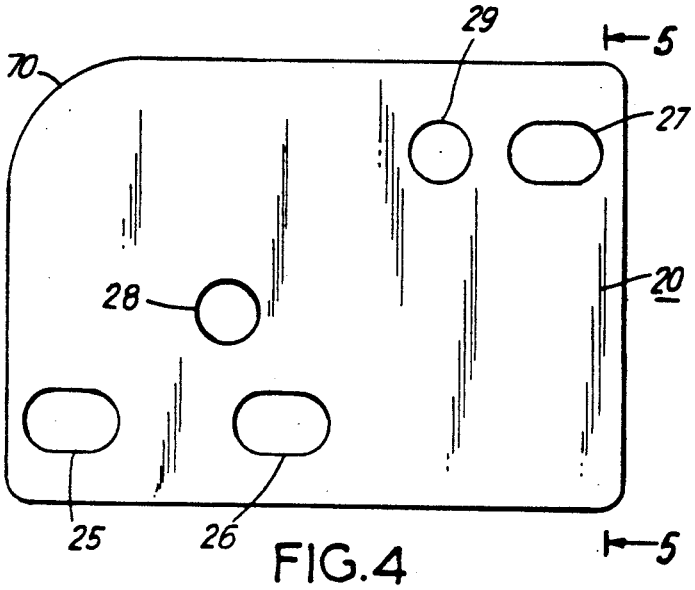
FIG. 4 is a plan view of a gusset plate of the present invention.

Referring now to the drawings and more particularly to FIG. 1, there is shown generally a retaining wall structure 10 which comprises a plurality of cooperating structural units 50 interconnected by fastening means 40 and reinforced by gusset plates 20 mounted to each unit using securing means 30.

As shown in FIGS. 2 and 3, each unit includes an upper wall 51 and a lower or support wall 52 having end surfaces or side walls 53, 54 and 55 mounted generally perpendicular to the upper and lower walls forming a rectangular box-like structure open on one side 64.

Each wall unit also includes a series of rib members 58 disposed generally perpendicular to and extending between the upper and lower surfaces at intervals along the lengths thereof, as best seen in FIG. 1. Flaps 59, 60 on each of the upper and lower surfaces, respectively, extend over portions of open end 64 to meet rib members 58 at upper and lower rib ends 68, 69, respectively. Flaps 59, 60 are mounted to the rib members using suitable fasteners. These flaps provide added reinforcement to the wall unit.

Side walls 53, 55 of each wall unit are formed by folded portions 56 and 57, respectively, of the upper and lower walls 51, 52 and folded portion 67 of side wall 54. Upon folding the respective folded portions of the upper and lower walls 51, 52 and side wall 54 onto the same plane, end surfaces are formed for cooperation with adjacent wall units. Each portion 56, 57 is separated an even distance from the corresponding folded portion 67 to permit movement of the folded portions relative to one another upon flexure of the rigid structure.

Each sidewall or end surface 53, 55 includes holes 41, 42 and 43 for receiving fasteners 40, as shown in FIG. 1, such as bolts or the like to secure adjacent wall units one to the other. In the present embodiment, end surfaces 53, 55 may be mounted at an angle to end surfaces of adjoining units to permit the formation of different pathway shapes upon assembly of the wall units in series. Alternatively, each end surface 53, 55 may be positioned at a suitable angle with respect to side surface 54 so as to create a like effect, i.e. form a circuitous swimming pool wall structure, upon assembly of a number of wall units in series.

Figure 5:
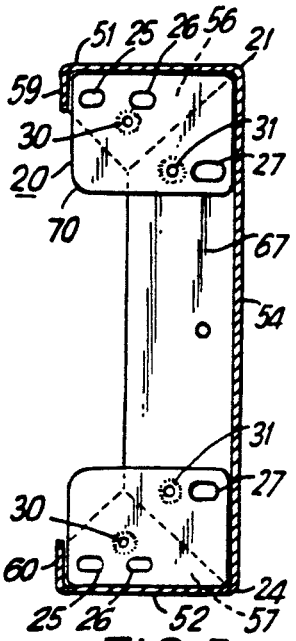
FIG. 5 is a sectional view of the retaining wall unit of FIG. 2 taken along 6—6.
Figure 8:
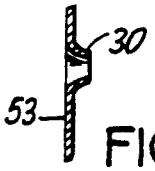
FIG. 8 is an enlarged view of the bent peripheral edges of the opening of a complementary connector.
Figure 6:
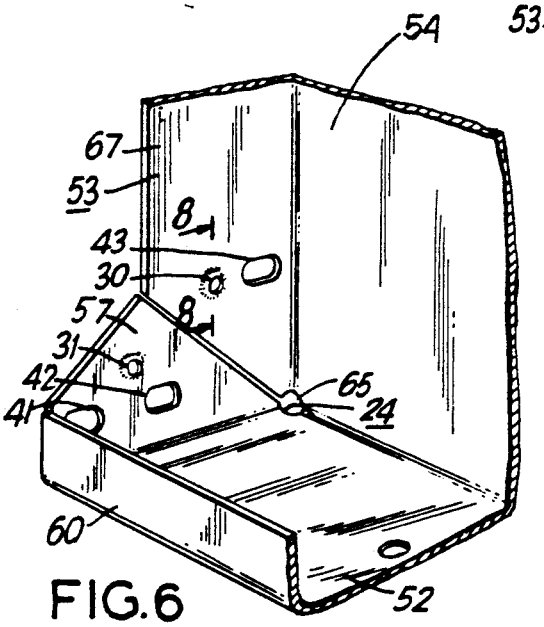
FIG. 6 is a perspective view of an interior end corner of the retaining wall unit of FIG. 2.
Figure 7:
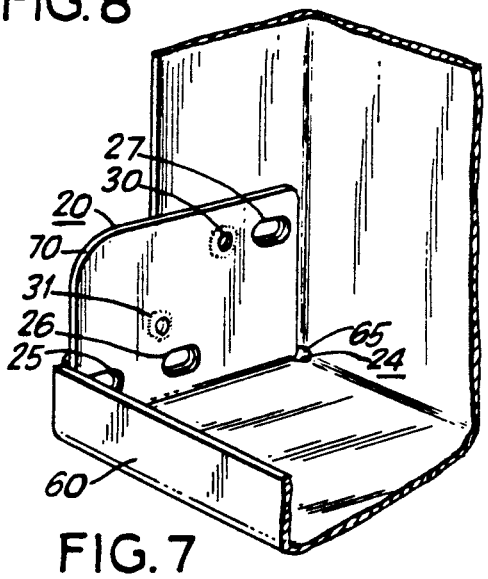
FIG. 7 is a perspective view of the interior end corner of FIG. 6 showing the gusset plate mounted to the end surface folds.

Referring now to FIGS. 2–7, gusset plates 20 are mounted at corners 21, 22, 23, 24 across aligned edge portions 56*a*, 67*a* (shown in FIG. 3) and across aligned edge portions 57*a*, 67*b*. Each gusset plate has apertures 28, 29 positioned for alignment with the corresponding complementary connectors or securing means 30, 31 formed in the end surfaces. Each gusset comprises a puncture opening in the end surface, the peripheral edges of the opening being bent. Each plate also has holes 25, 26 and 27 positioned for alignment with holes 41, 42 and 43, respectively, in the end surface. Upon alignment of the holes and positioning of the gusset plate against the end surface, the plate is mounted to the end surface using gussets 30, 31 or the like through apertures 28, 29 of the gusset plate, as best seen in FIGS. 5–7.

The complementary connectors each comprise a puncture opening in a respective end surface, the peripheral edges of the opening being bent. After the bent edges pass through one of the apertures 28, 29, they are bent back over corresponding edges of the apertures so as to secure the gusset plate to the end surface.

In addition, drainage holes 65 are formed at corners 21, 22, 23 and 24 to prevent the accumulation of moisture in the walls units, as best seen in FIG. 6.

Apertures 28, 29 are positioned on each side of the aligned edge portions of the upper surface (or the lower surface) and the side surface folded portions so as to brace the folds in a fixed position when the plate is joined to the end surfaces. Whether the swimming pool is filled with water or is empty, this novel bracing system adds strength to the retaining wall structure crucial for withstanding the pulling forces exerted between each wall unit. Moreover, this bracing system reinforces the assembled retaining wall structure without the need for welding.

As best seen in FIG. 4, each gusset plate is generally flat and rectangular in shape, having a selected size to fit into each corner of the wall unit. One edge 70 of each plate, in particular the edge of the plate exposed upon mounting the plate to the end surface, is rounded to provide safety in construction of the swimming pool wall structure. This gusset plate structure is advantageous over conventional apparatus in being simple to manufacture.

Each wall unit is reinforced by first folding a corresponding set of upper, lower and side surface folded portions onto the same plane such that the respective edge portions are in alignment with one another. Then, each gusset plate 20 is positioned against the interior side of end surfaces 53, 55 proximate to the wall unit corners such that holes 25, 26 and 27 in the gusset plates are aligned with the respective holes 41, 42, and 43 in the end surface. Finally, gussets 30, 31 are formed in the folded portions, one adjacent each edge portion, for cooperation with apertures 28, 29 so as to secure the gusset plates to the side walls for reinforcement of the structure.

To assemble retaining wall structure 10, wall units are positioned upright and in series along the periphery of a ground excavation for an in ground swimming pool. Each unit is oriented such that the open side 64 faces the wall of the excavation. As shown in FIG. 1, the end surfaces of each unit are then placed face-to-face against the corresponding end surfaces of adjacent units such that the corresponding holes in each of the facially disposed end surfaces are in alignment with one another. Finally, the end surfaces are mounted to each other through holes 41, 42 and 43 using suitable fasteners. Upon mounting all of the units end to end along the periphery of the excavation, the circuitous pathway of a swimming pool wall is formed.

The apparatus of the present invention may be constructed of a variety of different materials. However, one should keep in mind when selecting the materials to be used the stresses to which the apparatus will be subjected in the underground environment. For example, although the wall structure has been depicted as being made of galvanized steel, any material can be utilized given consideration to the underground environment for which the present invention is intended.

The above-described arrangement and methodology is merely illustrative of the principles of the present invention. Numerous modifications and adaptions thereof will be readily apparent to those skilled in the art without departing from the spirit and scope of the present invention. Thus, for example, the retaining wall structure could also be used to line the interior wall of an above ground concrete swimming pool shell or serve as a free-standing support structure.

What is claimed is:

1. An improved retaining wall structure for swimming pools comprising:

a plurality of structural units assembled in series, each unit having relatively planar end surfaces;

at least one of said surfaces being formed to facilitate engagement with a corresponding end surface of an adjacent unit;

means for fastening the units end to end so as to form a circuitous wall structure;

means mounted to each unit for supporting the unit in an upright position;

a gusset plate engaged with at least one of said end surfaces; and means for securing said gusset plate to said end surface so as to provide reinforcement to said wall structure;

at least one of said end surfaces comprises a pair of folded portions adjacent to one another, said portions forming a corner of one of said structural units, each of said portions overlying said gusset plate in a manner which provides reinforcement to said structure upon securing said gusset plate to each of said portions proximate to a corner of one of said structural units, said portions being configured so as to form a drainage hole adjacent to said corner;

at least one of said end surfaces including a plurality of holes for receiving said fastening means and oriented so as to enable the attachment of retaining wall structures one to the other;

said end surfaces having complementary connector means for securing said gusset plate to said end surface so as to provide reinforcement to said wall structure;

said gusset plate including apertures receiving said connector means for reinforcement of said structure; and said connector means including bent edges about the periphery of openings in said end surfaces, the openings being aligned with said apertures so as to enable engagement of said edges with said apertures.

2. The retaining wall structure set forth in claim 1 wherein each of said folded portions includes an edge portion generally parallel to a corresponding edge portion of an adjacent folded portion so as to form a space therebetween.

3. An improved structural unit for retaining walls of swimming pools comprising:

an end surface formed for cooperative engagement with an end surface of a like structural unit;

means mounted to said unit for supporting said unit in an upright position;

a gusset plate engaged with said end surface;

means for securing said gusset plate to said end surface so as to provide reinforcement to said unit;

said end surface comprising a pair of folded portions adjacent to one another, each of said portions overlying said gusset plate in a manner which provides reinforcement to said unit upon securing said gusset plate to each of said portions proximate to a corner of said structural unit, said portions being configured so as to form a drainage hole adjacent to said corner;

said end surface including a plurality of holes for receiving said securing means and oriented so as to enable the attachment of said unit to a like structural unit;

said end surface having complementary connector means for securing said gusset plate to said end surface so as to provide reinforcement to said unit;

said gusset plate including apertures receiving said connector means for reinforcement of said structure; and said connector means including bent edges about the periphery of openings in said end surface, the openings being aligned with said apertures so as to enable engagement of said edges with said apertures.

4. The improved structural unit set forth in claim 3 wherein each of said folded portions includes an edge portion generally parallel to an edge portion of an adjacent folded portion so as to form a space therebetween, said folded portions overlapping said gusset plate so as to provide reinforcement to said unit upon securing each folded portion to said gusset plate.

5. A method for reinforcing a structural unit for a swimming pool retaining wall comprising the steps of:

a) folding end surfaces of said structural unit so as to align an edge of one of said surfaces with a corresponding edge of another of said surfaces, said aligned edges forming a draining hole adjacent to a corner of said structural unit;

b) positioning a gusset plate into engagement with at least two of said end surfaces;

c) aligning apertures in said gusset plate with holes in each of said two end surfaces; and d) securing said gusset plate to said end surfaces proximate to a corner of one of said structural units.

6. A method according to claim 5 wherein step c is performed prior to, or simultaneously with, step b.

* * * * *